US006096955A

United States Patent [19]

Ter Heide

[11] Patent Number: 6,096,955

[45] Date of Patent: Aug. 1, 2000

[54] DEVICE FOR SUPPORTING A MUSICAL INSTRUMENT

[75] Inventor: Jan Anno Ter Heide, Joure, Netherlands

[73] Assignee: Vancore Percussion Instruments B.V., Joure, Netherlands

[21] Appl. No.: 09/142,697

[22] PCT Filed: Mar. 13, 1997

[86] PCT No.: PCT/NL97/00130

§ 371 Date: Feb. 4, 1999

§ 102(e) Date: Feb. 4, 1999

[87] PCT Pub. No.: WO97/34287

PCT Pub. Date: Sep. 18, 1997

[30] Foreign Application Priority Data

Mar. 13, 1996 [NL] Netherlands ..... 1002590

[51] Int. Cl.[7] ..... G10D 13/02

[52] U.S. Cl. ..... 84/421; 84/403

[58] Field of Search ..... 84/421, 412, 403, 84/DIG. 3, DIG. 12

[56] References Cited

U.S. PATENT DOCUMENTS

| | | | |
|---|---|---|---|
| 2,194,545 | 3/1940 | Firestone | 84/403 |
| 5,106,157 | 4/1992 | Nagelkirk et al. | 297/304 |
| 5,531,148 | 7/1996 | Wilson | 84/412 |

*Primary Examiner*—Stanley J. Witkowski
*Assistant Examiner*—Shih-yung Hsieh
*Attorney, Agent, or Firm*—Evenson, McKeown, Edwards & Lenahan, P.L.L.C.

[57] ABSTRACT

The invention relates to a device for supporting a musical instrument, in particular a percussion instrument such as a xylophone, marimba or drum. The device includes a frame and a carrier body connected to the frame and the musical instrument. The frame has an adjuster for positioning the musical instrument at a desired height and a damper for suppressing vibrations at least during playing of the instrument. The adjuster has at least one resilient mechanism adjustable in the length corresponding with the height of the musical instrument, wherein the adjuster and the damper form a unit.

18 Claims, 3 Drawing Sheets

DEVICE FOR SUPPORTING A MUSICAL INSTRUMENT

BACKGROUND OF THE INVENTION

The present invention relates to a device for supporting a musical instrument, in particular a percussion instrument such as a xylophone, marimba or drum, comprising:

a frame; and a carrier body connected to the frame and the musical instrument;

wherein the frame comprises adjusting means for positioning the musical instrument at a desired height and damping means for suppressing vibrations at least during playing of the instrument.

Such a device is known from the Netherlands patent application 9000633, wherein the adjusting means are designed as a screw spindle and the damping means are designed separately of the adjusting means as a plurality of shafts, each embedded in resilient material in the interior of a sleeve.

Prior art devices have the drawback that the construction thereof is complex. Related hereto the costs of a known device are high and ease of operation is poor. In addition, the damping means are bulky relative to the format of the frame and the musical instrument, which results in aesthetic terms in a not very attractive appearance of the device, which is a particular shortcoming for the intended use in combination with musical instruments.

SUMMARY OF THE INVENTION

The present invention has for its object to provide a solution to at least the above stated drawback and provides for this purpose a device which is distinguished in that the adjusting means comprise at least one resilient mechanism adjustable in the length corresponding with the height of the musical instrument, wherein the adjusting means and the damping means form a unit.

In a device according to the present invention having at least the above stated properties an effective damping of vibrations is realized in addition to an elegant and simple appearance by using a small number of components, wherein the ease of operation is moreover improved. This smaller number of components is realized because the adjusting means and the damping means form a unit, wherein this unit is suitable to damp vibrations both during playing and during transporting of the musical instrument.

In a first preferred embodiment the mechanism is arranged for operation substantially between the frame and the carrier body. The simplicity of the device is herein optimal, wherein the design is very effective and attractive but nevertheless displays optimal damping characteristics. Particularly because of these damping characteristics a device according to the present invention is in addition eminently suitable to more than sufficiently damp vibrations occurring during transport of the instrument on the frame, this to protect the instrument.

In a second preferred embodiment a device according to the present invention has the property that the mechanism comprises a gas spring. A gas spring in particular is highly suitable to simultaneously fulfil the function of adjusting means and the function of damping means. The damping characteristic is hereby optimized and adjustment of the musical instrument to a desired playing height is very simple. The gas spring is of course provided for this purpose with a control handle. The damping of vibrations both during transport and during playing of the musical instrument is effected as a result of the free stroke a gas spring inherently displays, this without affecting to any noticeable extent the sensation of playing the musical instrument.

In a third embodiment the device has the property that the mechanism comprises spring means for a free stroke of at least 0.25 cm and at most 7.5 cm, and preferably of approximately 2.5 cm. In the case a gas spring is used as mechanism, such a free stroke can be effected inter alia by influencing or adjusting the pressure prevailing in the interior thereof. This pressure depends in this case on at least the weight of the musical instrument and of the carrier body and the desired free stroke. The pressure in the interior of the gas spring preferably amounts to approximately 250 N.

BRIEF DESCRIPTION OF THE DRAWINGS

The present invention is further elucidated with reference to the figure description of an embodiment following hereinbelow. In the drawing.

DETAILED DESCRIPTION OF PREFERRED EMBODIMENTS

Figure 1:
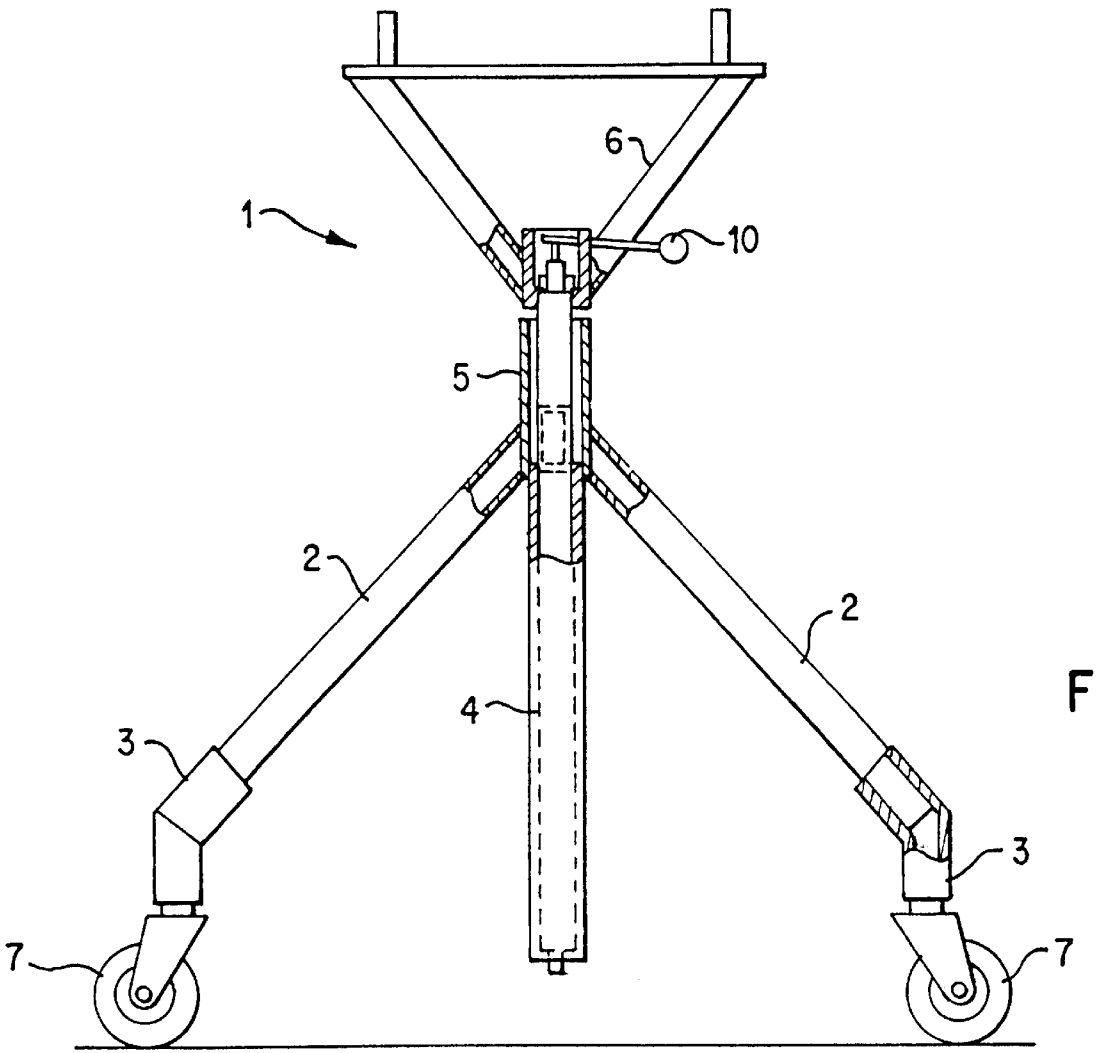
FIG. 1 is a schematic view of a part of a supporting device according to the present invention.

The embodiment of the invention depicted in FIG. 1 comprises: a frame in the form of legs 2, wherein the downward directed outer ends of legs 2 are provided with wheel supports 3 for wheels 7; damping means in the form of a gas spring 4 and also serving in the embodiment shown here as adjusting means; and a carrier body in the form of a head piece 6 for supporting the musical instrument.

Figure 2:
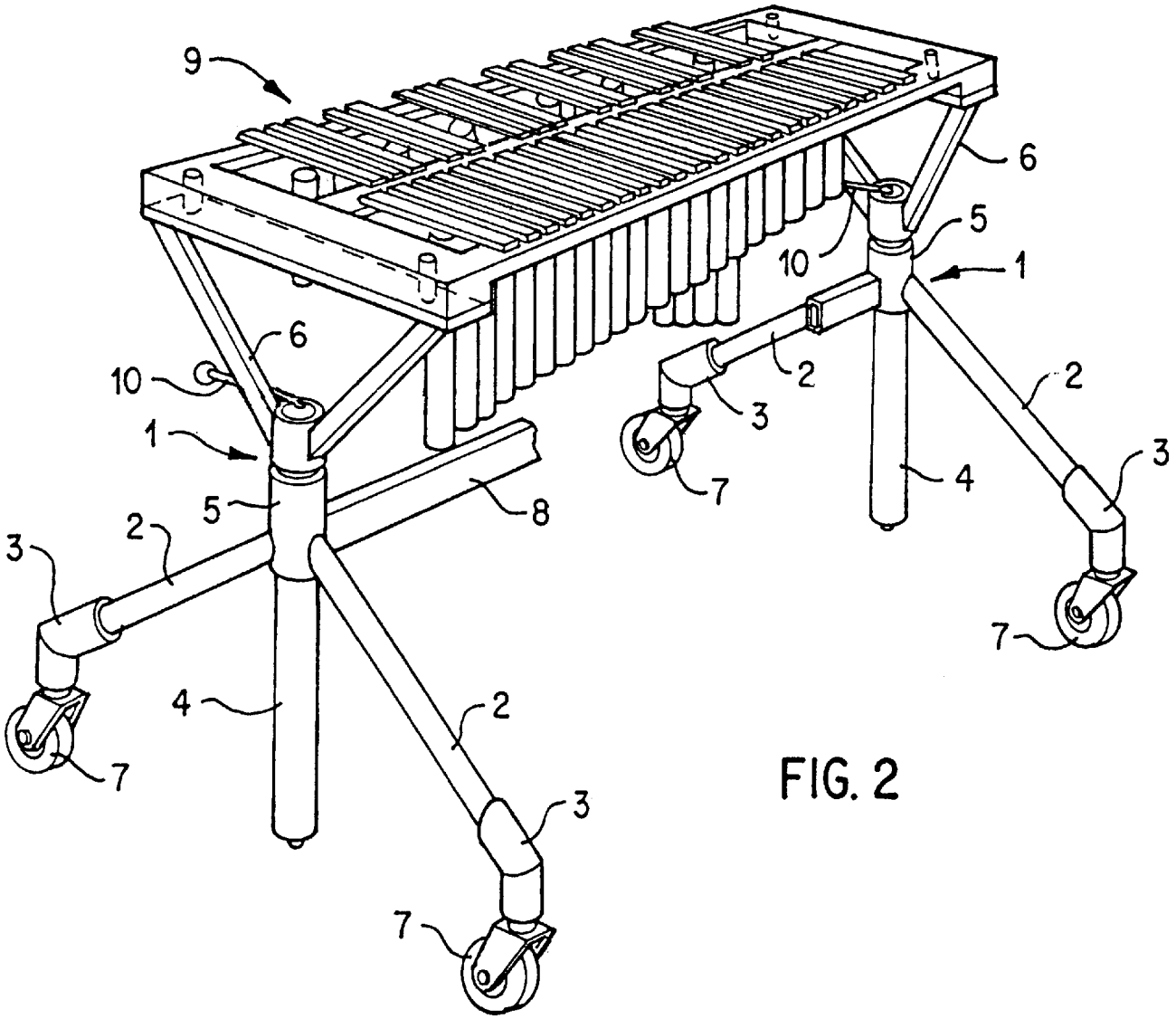
FIG. 2 is a perspective view of a musical instrument with a supporting device according to the present invention.

FIG. 1 shows half a supporting device according to the present invention. The other half of the supporting device according to the present invention is preferably identical to the half shown in this figure, wherein the two parts are mutually connected by means of a girder 8, as shown in FIG. 2. The frame therefore substantially comprises the legs 2 and the girder 8 connecting legs 2.

Legs 2 are fixed to each other in the form of a reverse V, wherein to the free ends of legs 2 are fixed the wheel supports 3 to which swivel castors 7 are preferably coupled. At the position of the fixing of legs 2 to each other a guide sleeve 5 is also arranged on legs 2, in which guide sleeve 5 is placed gas spring 4. The head piece 6 is arranged on gas spring 4 for movement relative to legs 2 and guide sleeve 5 in order to effect height adjustment of the musical instrument placed on head piece 6, which in the embodiment shown in FIG. 2 is a xylophone 9. Control means for gas spring 4 for the purpose of effecting this height adjustment are embodied as handle 10.

Gas spring 4 preferably has a free stroke which amounts substantially to between 0.25 cm and 7.5 cm to bring about the damping action.

The free stroke preferably amounts to 0.25 cm to obtain adequate damping as well as reliable height adjustment.

In order to obtain a free stroke under the influence of the weight of the musical instrument and of the carrier body such that adequate damping and reliable height adjustment are obtained, the pressure in the gas spring amounts to roughly 250 N. In order to obtain a desired optimal free stroke account is therefore taken of the weight of the musical instrument, the weight of the carrier body, the force of strokes on the musical instrument and the amplitude of vibrations through the supporting device, the dimensions of the gas spring etc., in order to adjust the pressure of the gas spring in accordance therewith.

Figure 3:
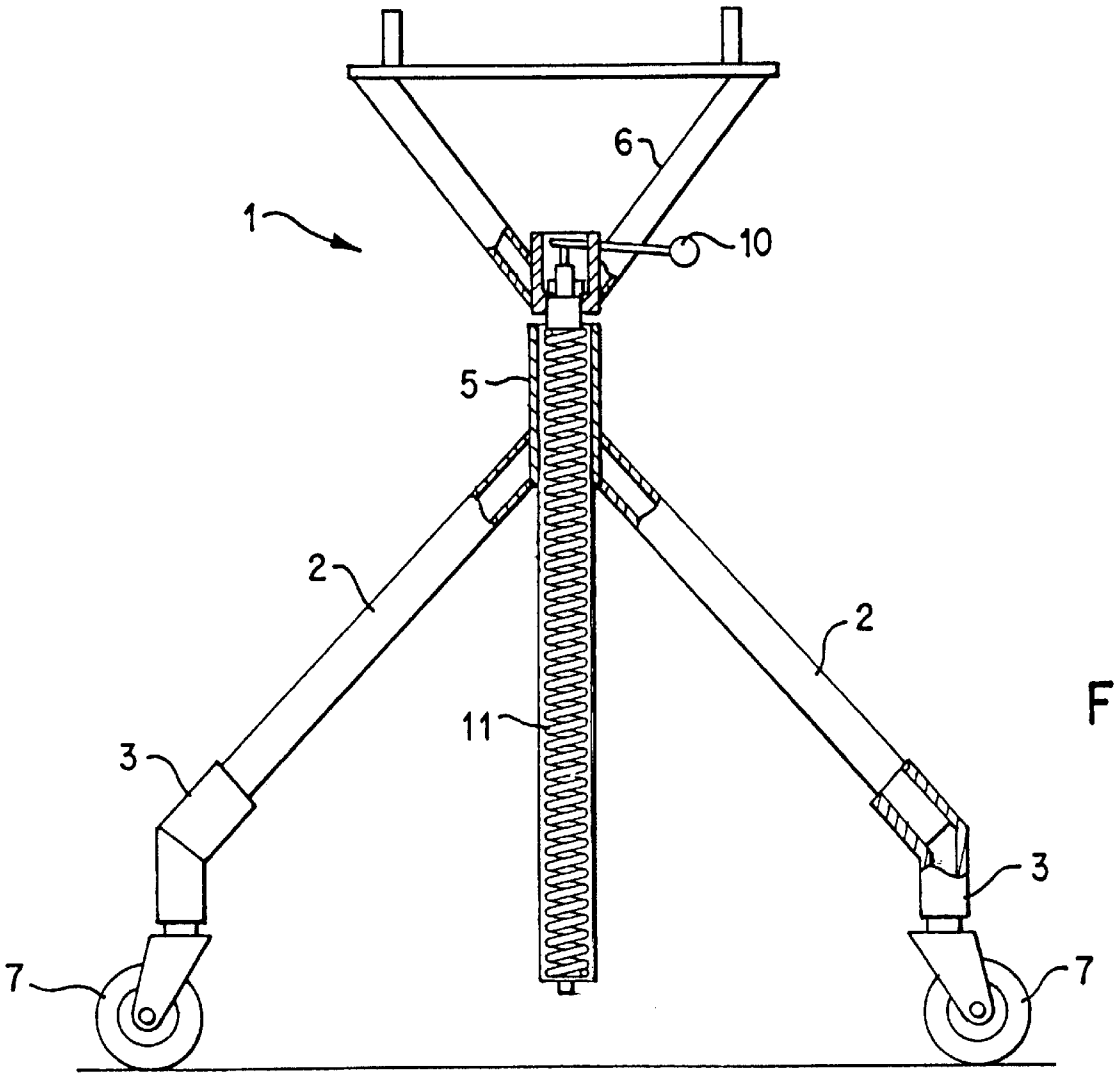
FIG. 3 is a schematic view of a part of a supporting device according to another embodiment of the present invention.

FIG. 3 shows another embodiment of the invention where a coil spring 11 is used instead of a gas spring.

The embodiment of a device according to the present invention described above in relation to the figures represents only one example thereof and many alternative embodiments within the scope of the present invention will occur to the skilled person. Here can be envisaged adjusting means for height adjustment which comprise a separate component and are not formed integrally with the damping means. The adjusting means herein allow movement in a predetermined range which, close to the set desired height, is greater than or equal to the free stroke of the damping means. The configuration wherein the adjusting means and the damping means form a unit is however recommended because of the comparative simplicity thereof and the associated ease of operation.

It is further possible within the scope of the invention to arrange the adjusting means and/or the damping means between the floor and the frame, between the frame and the carrier body or between the carrier body and the musical instrument. It is moreover possible to embody the adjusting means and/or the damping means as forming a unit with or forming part of one or more of these components.

What is claimed is:

1. Device for supporting a musical instrument comprising:

a frame; and a carrier body connected to the frame and the musical instrument;

wherein the frame comprises an adjuster for positioning the musical instrument at a desired playing height and a damper for suppressing vibrations at least during playing of the instrument, wherein the adjuster comprises at least one resilient mechanism adjustable in the length corresponding with the height of the musical instrument, wherein the adjuster and the damper form a unit.

2. Device as claimed in claim 1, wherein the mechanism is arranged for operation substantially between the frame and the carrier body.

3. Device as claimed in claim 2, wherein the mechanism comprises a gas spring.

4. Device as claimed in claim 3, wherein the gas spring adjusting to a pressure prevailing in the interior thereof depending at least on the weight of the musical instrument and of the carrier body and the desired free stroke.

5. Device as claimed in claim 4, wherein the gas spring is set to a pressure of approximately 250 N.

6. Device as claimed in claim 2, wherein the mechanism comprises a spring for a free stroke of at least 0.25 cm and at most 7.5 cm.

7. Device as claimed in claim 6, wherein the mechanism comprises a spring for a free stroke of approximately 2.5 cm.

8. Device as claimed in claim 7, wherein the gas spring is adjusting to a pressure prevailing in the interior thereof depending at least on the weight of the musical instrument and of the carrier body and the desired free stroke.

9. Device as claimed in claim 8, wherein the gas spring is set to a pressure of approximately 250 N.

10. Device as claimed in claim 1, the mechanism comprises a gas spring.

11. Device as claimed in claim 10, wherein the gas spring is adjusting to a pressure prevailing in the interior thereof depending at least on the weight of the musical instrument and of the carrier body and the desired free stroke.

12. Device as claimed in claim 11, wherein the gas spring is set to a pressure of approximately 250 N.

13. Device as claimed in claim 10, wherein the gas spring has a free stroke of at least 0.25 cm and at most 7.5 cm.

14. Device as claimed in claim 13, wherein the gas spring has a free stroke of approximately 2.5 cm.

15. Device as claimed in claim 14, wherein the gas spring is adjusting to a pressure prevailing in the interior thereof depending at least on the weight of the musical instrument and of the carrier body and the desired free stroke.

16. Device as claimed in claim 15, wherein the gas spring is set to a pressure of approximately 250 N.

17. Device as claimed in claim 1, wherein the mechanism comprises a spring for a free stroke of at least 0.25 cm and at most 7.5 cm.

18. Device as claimed in claim 17, wherein the mechanism comprises a spring for a free stroke of approximately 2.5 cm.

* * * * *